US005823230A

United States Patent [19]

Freestone et al.

[11] Patent Number: 5,823,230

[45] Date of Patent: Oct. 20, 1998

[54] HEAT EXCHANGER ASSEMBLY METHOD AND TUBE PLUG FOR HEAT EXCHANGER

[75] Inventors: Kevin Lloyd Freestone, Warren, Pa.; Edward Olen Smouse, Lawtons, N.Y.; Mabel Winifred Smith, Sherman, N.Y.; Herbert Allen Weaver, Conewango Valley, N.Y.; Stephen Alan Parks; Alvan Harold Johnson, both of Jamestown, N.Y.; Brian Raymond Nelson, Frewsburg, N.Y.; Ronald Lee Brake, Sr., Jamestown, N.Y.; Jeremy Grant Suber, Kennedy, N.Y.

[73] Assignee: Valeo Engine Cooling Inc., Jamestown, N.Y.

[21] Appl. No.: 500,601

[22] Filed: Jul. 11, 1995

[51] Int. Cl.[6] ..... F16L 55/00

[52] U.S. Cl. ..... 138/89; 138/90

[58] Field of Search ..... 138/89, 89.3, 90, 138/96 R, 119; 165/71; 220/281, 309.1, 309.2, 350, 305, 213, 794; 215/353, 354, 362

[56] References Cited

U.S. PATENT DOCUMENTS

| | | | |
|---|---|---|---|
| Re. 15,491 | 11/1922 | Baum | 215/354 |
| 3,451,583 | 6/1969 | Lee, II | 138/89 |
| 3,555,656 | 1/1971 | Brown et al. | 138/89 |
| 4,178,966 | 12/1979 | Savor et al. | 138/89 |
| 4,502,511 | 3/1985 | Zafred | 139/89 |
| 4,637,436 | 1/1987 | Stewart, Jr. et al. | 138/89 |
| 4,646,816 | 3/1987 | Rothstein | 138/89 |
| 4,694,863 | 9/1987 | Klopp | 138/96 R |
| 4,787,420 | 11/1988 | Wilhelm | 138/89 |
| 5,022,437 | 6/1991 | Pötz et al. | 138/89 |

*Primary Examiner*—Denise L. Ferensic
*Assistant Examiner*—James F. Hook
*Attorney, Agent, or Firm*—Morgan & Finnegan, LLP

[57] ABSTRACT

A novel tube plug which may be used to plug selected tubes in a heat exchanger has a cap portion for substantially closing a heat exchanger tube and a tube engaging portion depending from the cap portion, for insertion into the tube to retain the tube plug. By applying solder to the tube plug, the tube is sealed off, without providing a large solder mass which could cause damage due to thermal stresses.

1 Claim, 2 Drawing Sheets

HEAT EXCHANGER ASSEMBLY METHOD AND TUBE PLUG FOR HEAT EXCHANGER

FIELD OF THE INVENTION

The present invention relates to a method of assembling a heat exchanger, and more particular but not exclusively to a method of assembling an internal combustion engine cooling radiator. The present invention also relates to a novel tube plug which may be used to plug selected tubes in such a radiator either during manufacture or to perform a repair.

BACKGROUND OF THE INVENTION

Radiators for internal combustion engine coolant may comprise a header tank affording access to a relatively large number of tubes. In operation, relatively hot coolant is delivered to the header tank and passes, normally under pump action, through the tubes. The outside surfaces of the tubes are subjected to cooling air flow.

In manufacturing a radiator, the ends of the tubes are passed into correspondingly-dimensioned holes in the base of the header tank and the tube wall and header tank base are secured together, for example by soldering.

It is known that early failure of a radiator may occur due to leaks at the joints between the header tank and the outside row of tubes. Such early failure may be prevented by plugging the outside row of tubes, for example by heating the tube and feeding the solder into the tube until the solder caps the top of the tube. This however creates problems since formation of voids in the solder may allow leakage paths to develop during thermal cycling, which leakage may cause early failures. Also the relatively large mass of the solder plug makes the tube inflexible, and these features increase the likelihood of damage and failure due to thermal stresses. An alternative technique involves the placing of a shaped piece of metal into the tube to be plugged, thus reducing the amount of solder consumed in the plugging operation. Such pieces of metal are difficult to handle, and also reduce the flexibility of the tube.

It is accordingly an object of the present invention to at least partly overcome the above-mentioned disadvantages.

SUMMARY OF THE INVENTION

According to a first aspect of the present invention there is provided a tube plug for a heat exchanger, the tube plug having a longitudinal axis and comprising a cap portion adapted to at least substantially close a heat exchanger tube, the cap portion extending transversely of the axis and a tube-engaging portion depending from the cap portion and extending along the longitudinal axis, the tube-engaging portion being hollow.

Preferably the tube plug is formed from a sheet metal member.

Advantageously the sheet metal member defines an axial cross section which tapers outwardly in the axial direction along the tube-engaging portion to a location of maximal extent, then tapers inwardly along a connecting portion to a throat region whereat the sheet metal member extends substantially transversely to define the cap portion.

According to a second aspect of the present invention there is provided a sheet metal blank for a tube plug, the blank comprising two substantially rectangular portions separated by a waist portion.

According to a third aspect of the present invention there is provided a method of forming a plug member comprising:

providing a plug blank member of sheet metal, having two opposing ends and two opposing sides, and a transverse line of symmetry intermediate the ends;

reconfiguring the blank to define a first pair of contiguous regions disposed on either side of the line of symmetry, the first regions diverging from one another, a second pair of regions each contiguous with a respective one of the first pair of regions, the second regions converging towards a throat portion, and a pair of cap regions each contiguous with a respective one of the second regions in the throat portion, the pair of cap regions being disposed in mutually substantially opposite directions.

According to a fourth aspect of the present invention there is provided a method of assembling a heat exchanger comprising:

disposing heat exchanger tubes in corresponding apertures of the heat exchanger header;

providing at least one tube plug, the, or possibly each tube plug having a cap portion and a tube-engaging portion depending therefrom;

disposing the or each tube plug in selected heat exchanger tubes, whereby the tube-engaging portion engages the interior wall of the respective tube and the cap portion at least substantially closing the tube;

solder dipping the assembly formed from the header tank, tubes and tube plugs whereby the heat exchanger tubes are secured to the heat exchanger header and the selected tubes. According to a fifth aspect of the present invention there is provided a method of sealing a tube in a heat exchanger comprising:

providing a tube plug, the tube plug having a cap portion and a tube-engaging portion depending therefrom;

disposing the tube plug in the tube, whereby the tube-engaging portion engages the interior wall of the tube plug;

soldering the tube plug to the header tank and the tube whereby the tube is sealed.

BRIEF DESCRIPTION OF THE DRAWINGS

The invention will now be described with reference to the acompanying drawings in which.

In the figures, like reference numerals refer to like parts.

DESCRIPTION OF THE PREFERRED EMBODIMENT

Figure 1:
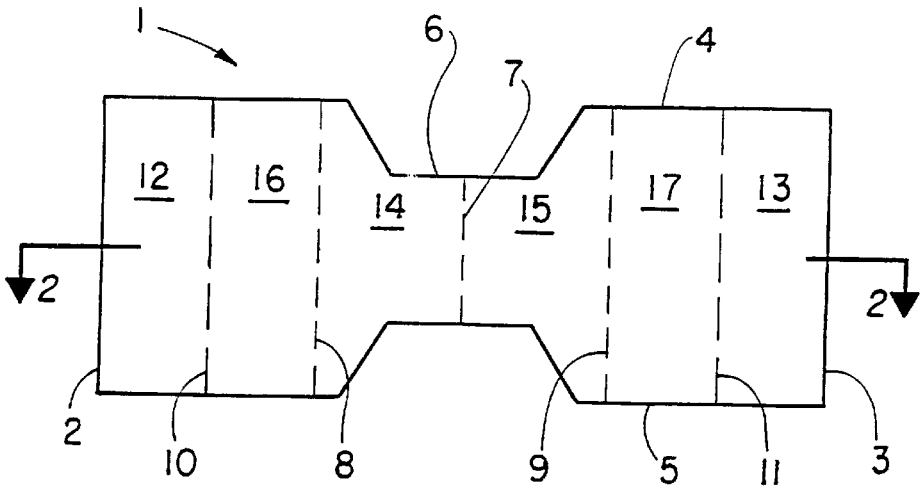
FIG. 1 shows a plan view of a tube plug blank.

Referring now to FIG. 1, the plug blank (1) consists of a generally rectangular sheet metal member, preferably of brass. The member has two opposing ends (2, 3) and two opposing sides (4, 5). Midway between the two ends (2, 3), the sides (4, 5) converge together to form a waist region (6). The plug blank is provided with transverse fold lines as follows:

A first fold line (7) in the waist region (6) and substantially midway between the ends (2, 3).

Second and third fold lines (8, 9) disposed substantially symmetrically about the first fold line (7) and fourth and fifth fold lines (10, 11) also disposed substantially symmetrically about the first fold line (7) and respectively between the second fold line (8) and the first end (2) and the third fold line (9) and the second end (3).

The fourth and fifth fold lines, together with the corresponding ends define respective end regions (12, 13) which, in the finished tube plug, constitute a cap portion adapted to at least substantially close a tube. The first and second fold lines (7, 8) and first and third fold lines (7, 9) define proximal regions (14, 15) therebetween, and the second and fourth, and third and fifth fold lines respectively define distal regions (16, 17) therebetween. In the completed tube plug, the proximal regions engage with the interior of a heat exchanger tube, and the distal regions allow for flexure of the proximal regions, and for spacing of the cap portion from the region of engagement with the tube.

Sight line II–II' extends substantially perpendicular to the first fold line (7), substantially midway between the sides (4, 5).

Figure 2:
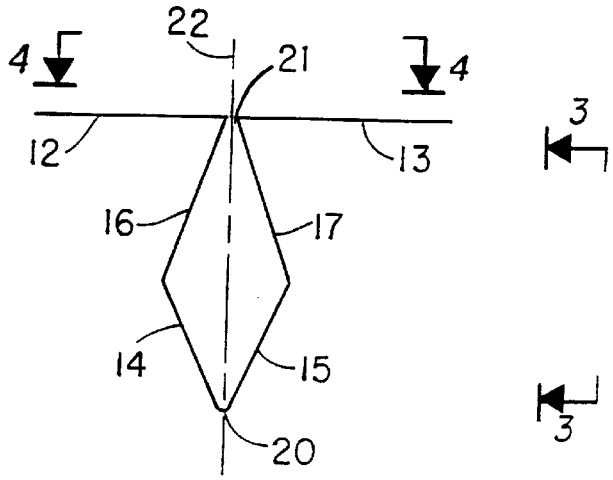
FIG. 2 shows an axial cross-sectional view through a tube plug formed from the blank of FIG. 1.

FIG. 2 shows a cross sectional view along the line II–II' of the tube plug in its erected condition.

Referring to FIG. 2, the blank is manipulated, e.g. by folding, so that the proximal portions (14, 15) are disposed at an acute angle to one another, the two portions meeting in a radius region (20) which includes the first fold line (7). Thus the proximal regions (14, 15) form, in cross section, a generally V-shaped configuration. The distal regions (16, 17), at the ends of the proximal regions are directed so as to taper towards one another to define a throat region (21) between the fourth and fifth fold lines (10, 11). The end portions (12, 13) are directed outwardly in substantially opposite directions.

In the orientation shown in FIG. 2, a line of symmetry (22) extends centrally through the throat region (21) and the radius region (20), and the end regions (12, 13) form the above-mentioned cap portion which is disposed substantially perpendicularly to the line of symmetry (22). As will be apparent, the proximal regions (14,15) form a hollow tube-engaging portion.

Figure 3:
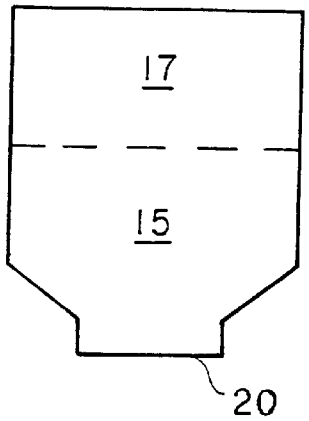
FIG. 3 shows a side elevation of the tube plug of FIG. 2.

FIG. 3 shows a side elevation taken in direction III of the tube plug of FIG. 2.

Figure 4:
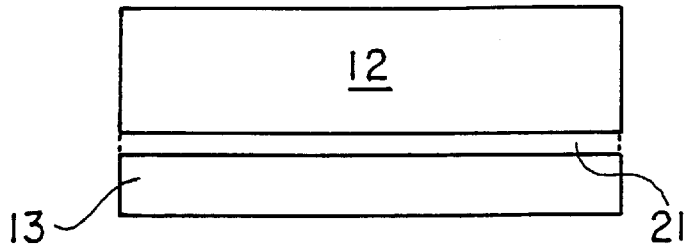
FIG. 4 shows a top plan view of the tube plug of FIG. 2.

FIG. 4 shows a plan view of the tube plug of FIG. 2 taken in the direction IV.

The erection of a tube plug may be performed by hand. Preferably however, a automatic stamping machine cuts the blanks from a brass sheet and erects the plugs.

Figure 5:
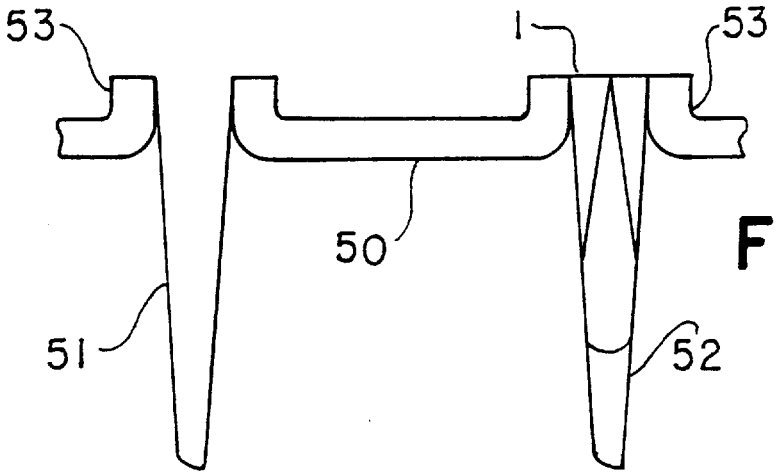
FIG. 5 shows a partial cross section through a radiator, showing a tube plug inserted in one of the radiator tubes
Figure 6:
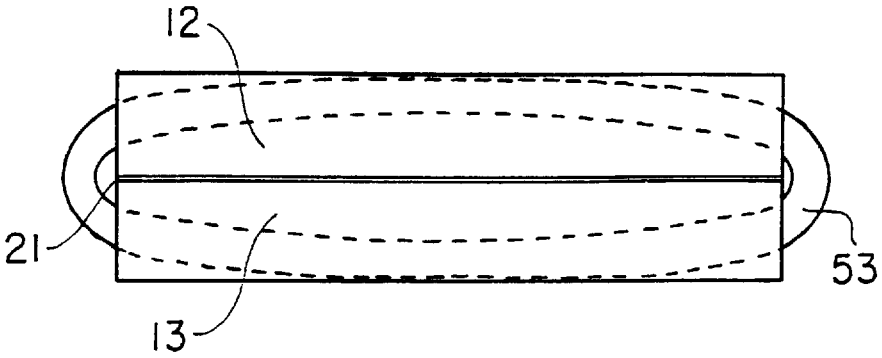
FIG. 6 shows a top plan view of the arrangement shown in FIG. 5.

Referring to FIG. 5, a partial cross section through a radiator is shown, illustrating the use of the tube plug (1). The radiator consists of header tank having a base plate (50) of brass, which has plural holes in it for accepting a plurality of heat exchanger tubes (51, 52). The remainder of the header tank may be of brass or copper, or may be, for example, a plastic tank connected to the base plate via a gasket. It will be understood by one skilled in the art that a large number of such tubes will be provided in a typical radiator. As shown in FIG. 5, the base plate (50), in the region immediately surrounding the holes has inwardly-directed (with respect to the interior of the header tank) flange portions (53). As shown in FIG. 6, the holes may be non-circular, and are preferably oval or elliptical.

Tubes (51, 52) of substantially uniform cross section are then inserted through the holes so that end regions of the tubes substantially coincide with the end portions of the flange regions (53) inside the header tank. The tubes are then expanded by a suitable mandrel so as to at least substantially conform with the inner periphery of the respective hole. The tube plug (1) may then be inserted into a desired tube, so that the engaging portion defined by regions (14, 15) engages the internal walls of the tube and the cap portion defined by end regions (12, 13) overlies the opening of the tube and the end of the flange region (53) to at least substantially close the tube.

Referring to FIG. 6, the cap portion formed by end regions (12, 13) is seen to extend outwardly beyond the flange region and only a small region of the tube, proximate the ends of the throat portion (21) is uncovered by the cap portion of the tube plug.

The assembly as a whole is then subject to fluxing and then to solder dipping. The solder dipping results in the unplugged tubes (51) being secured to the flange regions (53) of the header tank base (50) via the solder, the relatively narrow throat region (21) and the uncovered regions (60, 61) being filled by solder and the solder also bonds the cap portion (12, 13) being bonded to the ends of the flange regions (53) in a single operation.

The tube plug has several advantages. Firstly there is no large mass of plug within the tube, and as a result tube (52) is not prevented from flexing during thermal contraction and expansion cycles as would be the case if the tube were plugged with solid solder. The tube plug significantly reduces the amount of solder consumed during the tube plugging operation. The solder which is consumed in tube plugging, using the tube plug, is only required to form a bond between two closely spaced surfaces, which is the application for which current solders are designed. There is thus no requirement to fill large gaps, which requirement in the prior art gives rise to deleterious structures and voids.

It will be appreciated by one skilled in the art that where a tube fails during the service life of a radiator, a tube plug may be used to seal off the relevant tube for repair purposes. In that event, the tube plug is inserted into the desired tube as described above with reference to FIG. 6, and the plug is then manually soldered in place.

It will of course be apparent to one skilled in the art that the tube plug could be made of materials other than brass. Likewise, the heat exchanger could also be of other materials.

We claim:

1. A tube plug for a heat exchanger, the tube plug having a longitudinal axis and comprising a cap portion adapted to at least substantially close a heat exchanger tube, the cap portion extending transversely of the axis and a tube engaging portion depending from the cap portion and extending along the longitudinal axis, the tube engaging portion being hollow, wherein the tube plug is formed from a sheet metal member, and wherein the sheet metal member defines an axial cross section which tapers outwardly in the axial direction along the tube engaging portion to a location of maximal extent, then tapers inwardly along a connecting portion to a throat region, the connecting portion enabling the tube engaging portion to flex, wherein the sheet metal member extends substantially transversely to define the cap portion.

* * * * *